US005518182A

United States Patent [19]

Sasao

[11] Patent Number: 5,518,182

[45] Date of Patent: May 21, 1996

[54] SOLENOID TYPE FUEL INJECTION VALVE

[75] Inventor: Isamu Sasao, Miyagi, Japan

[73] Assignee: Kabushiki Kaisha Keihinseiki Seisakusho, Tokyo, Japan

[21] Appl. No.: 350,989

[22] Filed: Nov. 29, 1994

[30] Foreign Application Priority Data

Mar. 25, 1994 [JP] Japan ..... 6-056350

[51] Int. Cl.[6] ..... F02M 51/08; F02M 69/08

[52] U.S. Cl. ..... 239/412; 239/429; 239/432; 239/553.5; 239/585.4; 239/590.5

[58] Field of Search ..... 239/585.1–585.5, 239/533.12, 407, 412, 418, 429, 432, 553, 553.5, 590, 590.5

[56] References Cited

U.S. PATENT DOCUMENTS

| | | | |
|---|---|---|---|
| 4,497,443 | 2/1985 | Sauer | 239/533.3 |
| 4,519,370 | 5/1985 | Iwata | 239/533.12 X |
| 4,778,112 | 10/1988 | DeConcini et al. | 239/585.5 |
| 4,979,479 | 12/1990 | Furukawa | 239/533.12 X |
| 5,062,573 | 11/1991 | Makimura | 239/533.12 |
| 5,358,181 | 10/1994 | Tani et al. | 239/585.1 X |
| 5,423,489 | 7/1995 | Wood | 239/585.1 X |

FOREIGN PATENT DOCUMENTS

| | | | |
|---|---|---|---|
| 172458 | 10/1983 | Japan | 239/585.1 |

*Primary Examiner*—Kevin P. Weldon

*Attorney, Agent, or Firm*—Armstrong, Westerman, Hattori, McLeland & Naughton

[57] ABSTRACT

A solenoid type fuel injection valve for injecting fuel into a plurality of intake ports including a pintle provided at a lower end of a needle valve to protrude into a fuel atomizing space formed at a lower portion of a fuel injection hole, so that the fuel is atomized by collision against the pintle after passing through the fuel injection hole, and the atomized fuel is introduced into a fuel distributing space having an inclined wall surface. A pair of fuel spray guides are supported at a lower end of a cap through support arms, and a fuel injection passage having a horseshoe-like cross-sectional shape is formed around an outer periphery of each of the fuel spray guides. A fuel spray colliding against the inclined wall surface is divided into two flows which are conducted into the pair of fuel injection passages and injected equally into a bifurcated intake port.

8 Claims, 7 Drawing Sheets

SOLENOID TYPE FUEL INJECTION VALVE

BACKGROUND OF THE INVENTION

1. Field of the Invention

The present invention relates to a solenoid type fuel injection valve for injecting fuel into a plurality of intake ports in an engine.

2. Description of the Related Art

There are such conventionally known solenoid type fuel injection valves described in Japanese Utility Model Publication No.19578/93 and Japanese Utility Model Application Laid-open Nos.148065/89 and 54364/90, in which a needle valve includes no pintle, and axes of the needle valve and a fuel injection passage are offset from each other.

In the solenoid type fuel injection valves described in Japanese Utility Model Publication No.19578/93 and Japanese Utility Model Application Laid-open No.148065/89, a fuel injected through the fuel injection passage has of a beam-like shape, which is accompanied by a problem that all the fuel does not collide against a fuel collision portion, resulting in an insufficient atomization of the fuel.

In the solenoid type fuel injection valves described in Japanese Utility Model Application Laid-open No.54364/90, a fuel is bifurcated and injected into a beam-like shape through a pair of fuel injection passages, but there is a problem that the amount of fuel distributed is non-uniform due to a slight error in working of a top of the bifurcated portion of the passage.

SUMMARY OF THE INVENTION

Accordingly, it is an object of the present invention to provide a solenoid type fuel injection valve, wherein when fuel is injected and distributed into a plurality of intake ports in an engine, the atomization and distribution characteristics of the injected fuel can be enhanced.

To achieve the above object, according to a first aspect and feature of the present invention, there is provided a solenoid type fuel injection valve, comprising: a fuel injection hole formed in an injector body and opened and closed by a needle valve; a cap mounted at a tip end of the injector body; a fuel atomizing space formed at a position downstream of the fuel injection hole; a pintle provided at a tip end of the needle valve to extend through the fuel injection hole into the fuel atomizing space for atomizing a fuel passed through the fuel injection hole; a fuel distributing space formed in the cap, so that the fuel distributing space is connected to a downstream side of the fuel atomizing space; an inclined wall surface formed within the fuel distributing space to face a tip end of the pintle; and a plurality of fuel injection passages formed in the cap so as to be connected to a lower end of the inclined wall surface and offset from an axis of the pintle.

With the first feature, the fuel passing through the fuel injection hole can be effectively atomized by collision thereof against the pintle. Moreover, the atomized fuel is introduced into the plurality of fuel injection passages while being guided by the inclined wall surface provided in the fuel distributing space, and therefore, even if there is an error produced in the relative position between the fuel injection hole and the plurality of fuel injection passages, the fuel can be equally distributed to a plurality of intake ports in an engine. Further, to form a desired spray pattern, the shape of a cap of a prior art solenoid type fuel injection valve including a pintle need only be changed and therefore, the solenoid type fuel injection valve according to the present invention can be realized at an extremely low cost.

In addition, according to a second aspect and feature of the present invention, there is provided a solenoid type fuel injection valve, comprising: a fuel injection hole formed in an injector body and opened and closed by a needle valve; a cap mounted at a tip end of the injector body; a fuel atomizing space formed at a position downstream of the fuel injection hole; a pintle provided at a tip end of the needle valve to extend through the fuel injection hole into the fuel atomizing space for atomizing fuel passing through the fuel injection hole; a fuel distributing space formed in the cap, so that the fuel distributing space is connected to a downstream side of the fuel atomizing space; a plurality of fuel injection passages each having an annular cross-section and having at least one non-spray portion, which are formed downstream of the fuel distributing space, so that they are offset from an axis of the pintle; and a fuel spray forming portion which spreads downwardly and is provided within a downstream end of each of the fuel injection passages for spreading a fuel spray into a cone shape.

With the second feature, the plurality of fuel injection passages, into which the fuel atomized by the collision against the pintle is introduced, are formed into the annular cross section having the non-spray portion and therefore, it is possible to form a non-spray portion in a fuel spray pattern to prevent the deposition of the fuel on a rod portion of an intake valve. Moreover, it is possible to spread the fuel spray pattern into a correct cone shape to prevent the deposition of the fuel on a wall surface of an intake port.

Further, according to a third aspect and feature of the present invention, there is provided a solenoid type fuel injection valve, comprising: a fuel injection hole formed in an injector body and opened and closed by a needle valve; a cap mounted at a tip end of the injector body; a fuel atomizing space formed at a position downstream of the fuel injection hole; a pintle provided at a tip end of the needle valve to extend through the fuel injection hole into the fuel atomizing space for atomizing fuel passing through the fuel injection hole; a plurality of fuel spray guide means disposed within the cap downstream of the fuel atomizing space, such that the fuel spray guide means are offset from an axis of the pintle; fuel injection passages each formed so as to surround an outer periphery of each of the fuel spray guide means; and air assist passages each having an outlet opposed to each of the fuel spray guide means on the opposite side from the axis of the pintle.

Yet further, according to a fourth aspect and feature of the present invention, there is provided a solenoid type fuel injection valve, comprising: a fuel injection hole formed in an injector body and opened and closed by a needle valve; a cap mounted at a tip end of the injector body; a fuel atomizing space formed at a position downstream of the fuel injection hole; a pintle provided at a tip end of the needle valve to extend through the fuel injection hole into the fuel atomizing space for atomizing fuel passing through the fuel injection hole; a plurality of fuel spray guide means disposed within the cap downstream of the fuel atomizing space, such that the fuel spray guide means are offset from an axis of the pintle; fuel injection passages each formed so as to surround an outer periphery of each of the fuel spray guide means; and air assist passages each having an outlet opposed to each of the fuel spray guide means with a small gap left therebetween.

With the third and fourth features, the fuel atomized by collision against the pintle, when being introduced into the plurality of fuel injection passages, is subjected to the supply of assist air, whereby a further atomization and uniformization in particle size of the fuel can be promoted. Moreover, when the supplying of the assist air has been stopped, each of the fuel spray guide means act as a barrier, thereby preventing the fuel from entering the air assist passages from the fuel injection passages, so that the amount of fuel injected into the intake port can be maintained constant.

The above and other objects, features and advantages of the invention will become apparent from the following description of a preferred embodiment taken in conjunction with the accompanying drawings.

DESCRIPTION OF THE PREFERRED EMBODIMENT

Figure 1:
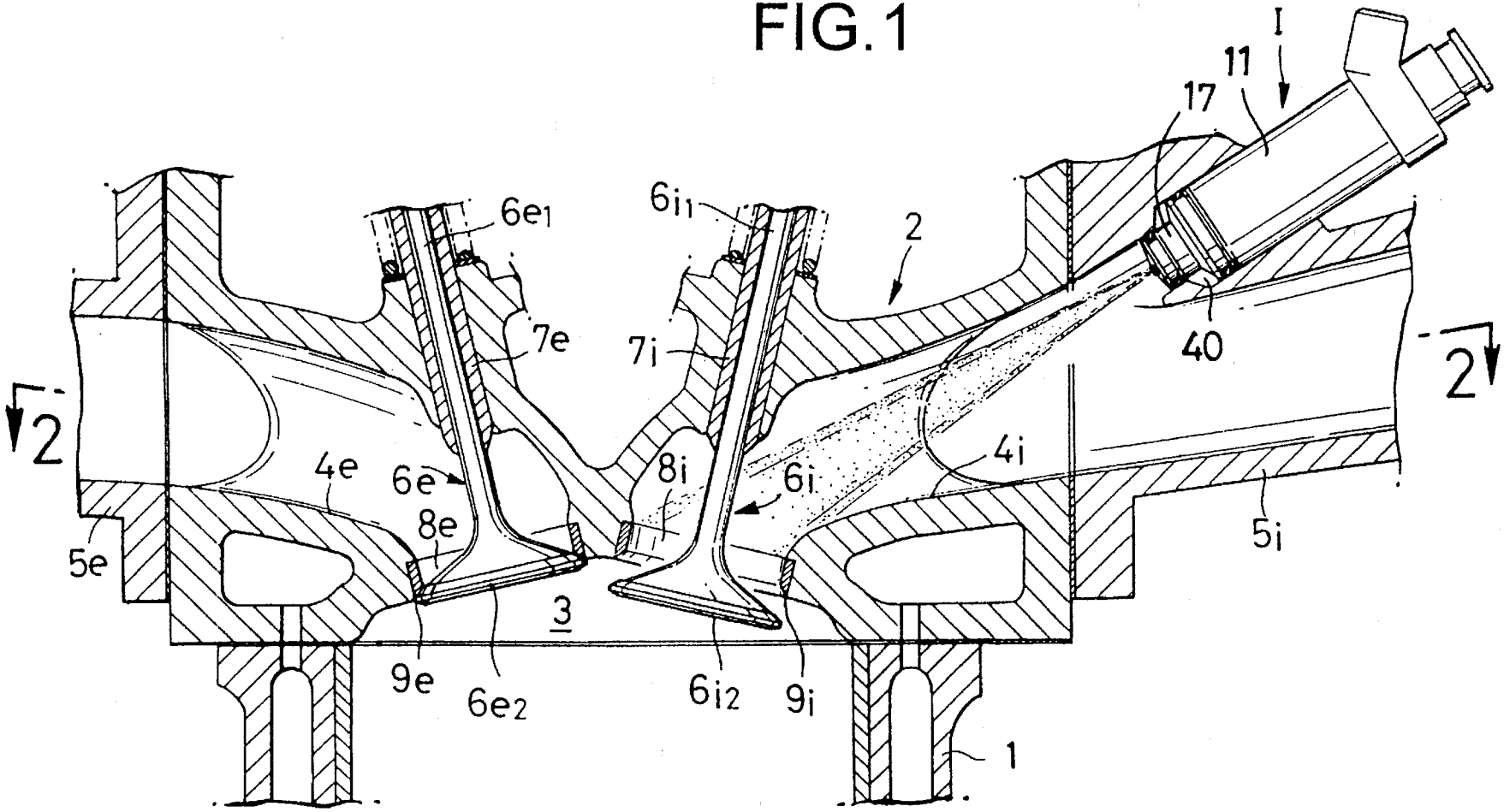
FIG. 1 is a vertical sectional side view of an essential portion of an engine including a solenoid type fuel injection valve according to an embodiment of the present invention.
Figure 2:
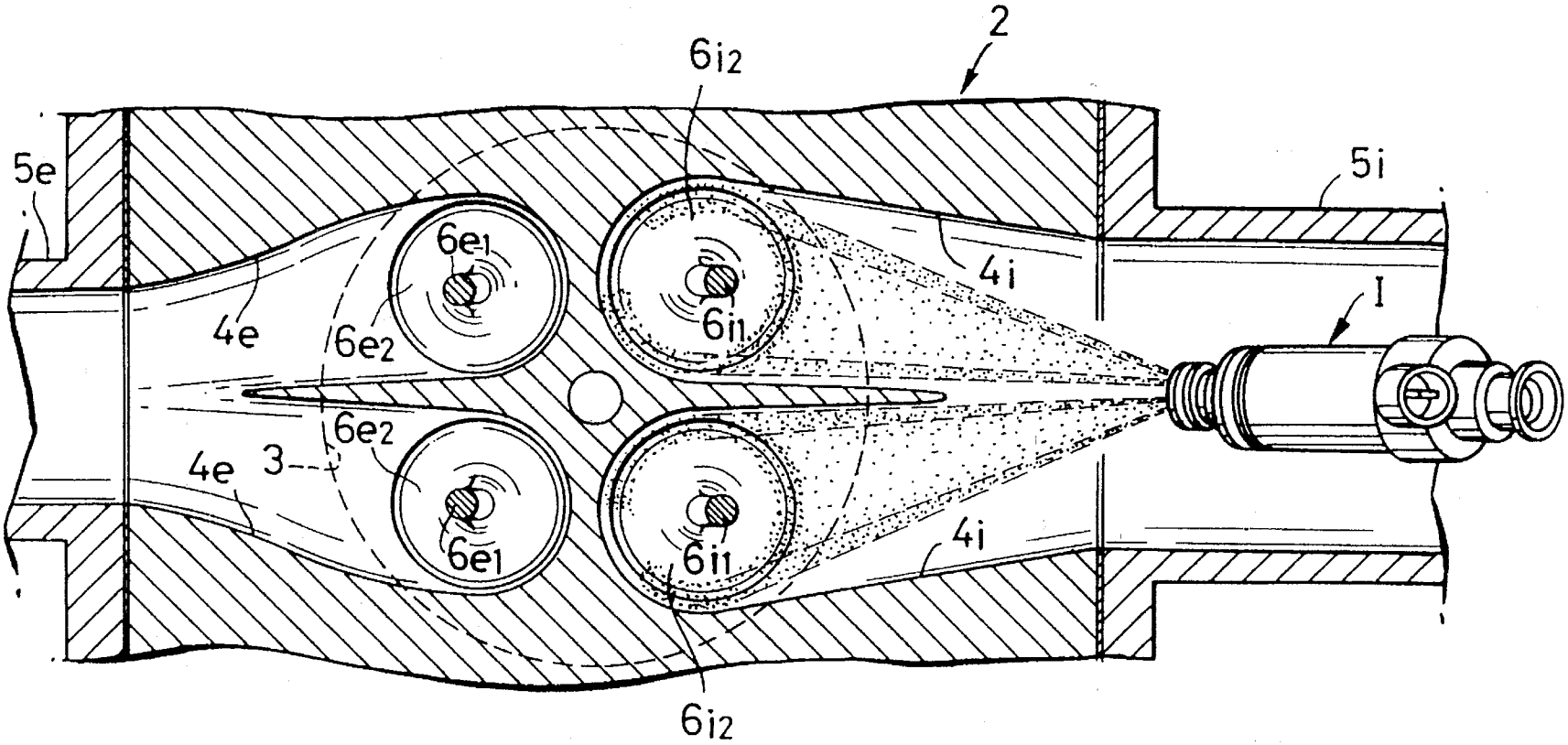
FIG. 2 is a sectional view taken along a line 2—2 in FIG. 1.

Referring to FIGS. 1 and 2, bifurcated intake ports 4*i*, 4*i* and bifurcated exhaust ports 4*e*, 4*e* are formed in a cylinder head 2 coupled to an upper surface of a cylinder block 1 of an engine to communicate with a combustion chamber 3. An intake manifold 5*i* and an exhaust manifold 5*e* are coupled to opposite sides of the cylinder head 2 and connected to the intake ports 4*i*, 4*i* and the exhaust ports 4*e*, 4*e*, respectively. A pair of intake valves 6*i*, 6*i* each has a rod portion $\mathbf{6}i_1$ and a valve head $\mathbf{6}i_2$. When the intake valves 6*i*, 6*i* with the rod portions $\mathbf{6}i_1$, $\mathbf{6}i_1$ slidably guided in valve guides 7*i*, 7*i* provided in the cylinder head 2 are vertically moved by a valve operating mechanism (not shown), the head portions $\mathbf{6}i_2$, $\mathbf{6}i_2$ are seated on and separated from valve seats 8*i*, 8*i* to open and close intake valve bores 9*i*, 9*i*. A pair of exhaust valves 6*e*, 6*e* each has a rod portion $\mathbf{6}e_1$ and a valve head $\mathbf{6}e_2$. When the exhaust valves 6*e*, 6*e* with the rod portions $\mathbf{6}e_1$, $\mathbf{6}e_1$ slidably guided in valve guides 7*e*, 7*e* provided in the cylinder head 2 are vertically moved by a valve operating mechanism (not shown), the head portions $\mathbf{6}e_2$, $\mathbf{6}e_2$ are seated on and separated from valve seats 8*e*, 8*e* to open and close exhaust valve bores 9*e*, 9*e*. A single solenoid type fuel injection valve I is provided in the intake manifold 5*i*. Fuel which is injected in a bifurcated manner from the solenoid type fuel injection valve I is supplied through the intake ports 4*i*, 4*i* into the intake valves 9*i*, 9*i*.

Figure 3:
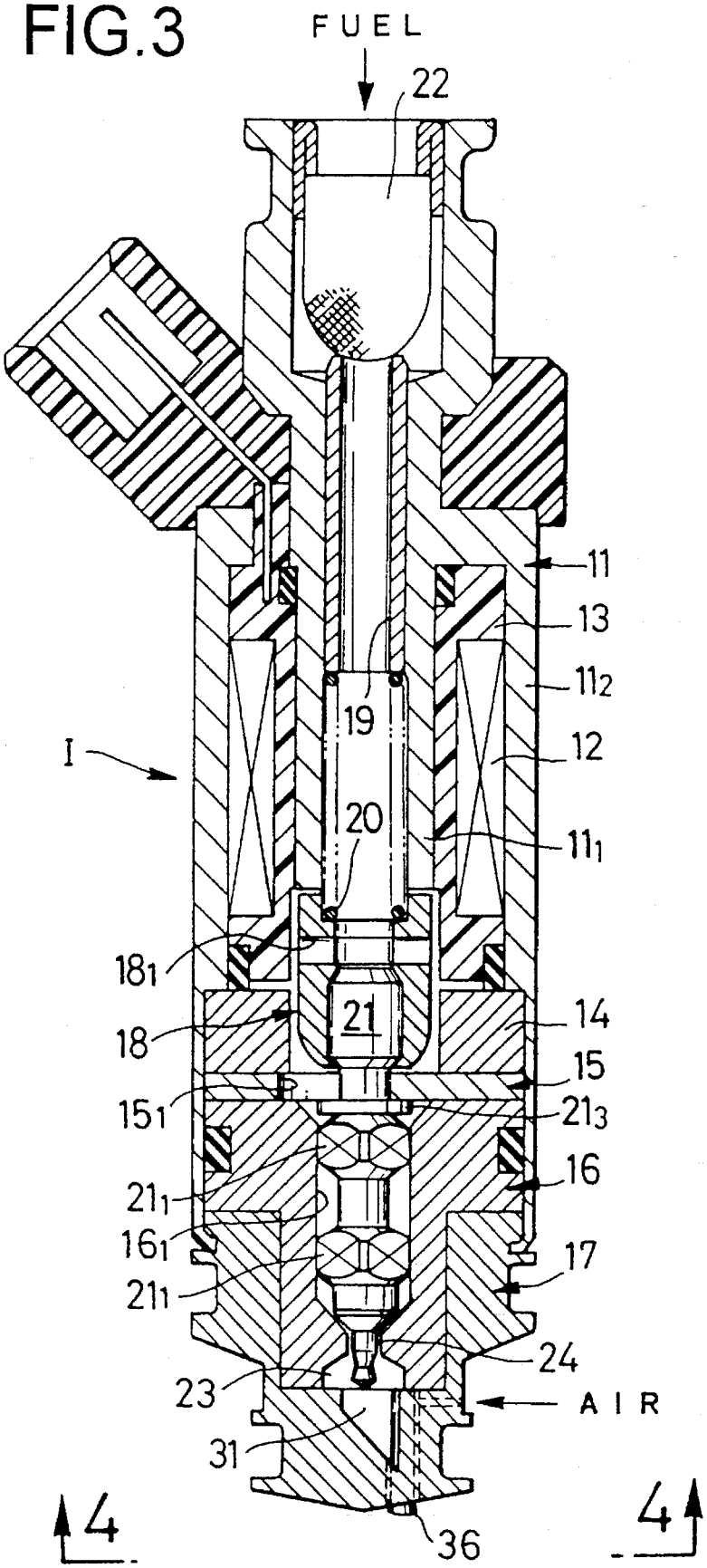
FIG. 3 is a vertical sectional side view of the fuel injection valve.
Figure 4:
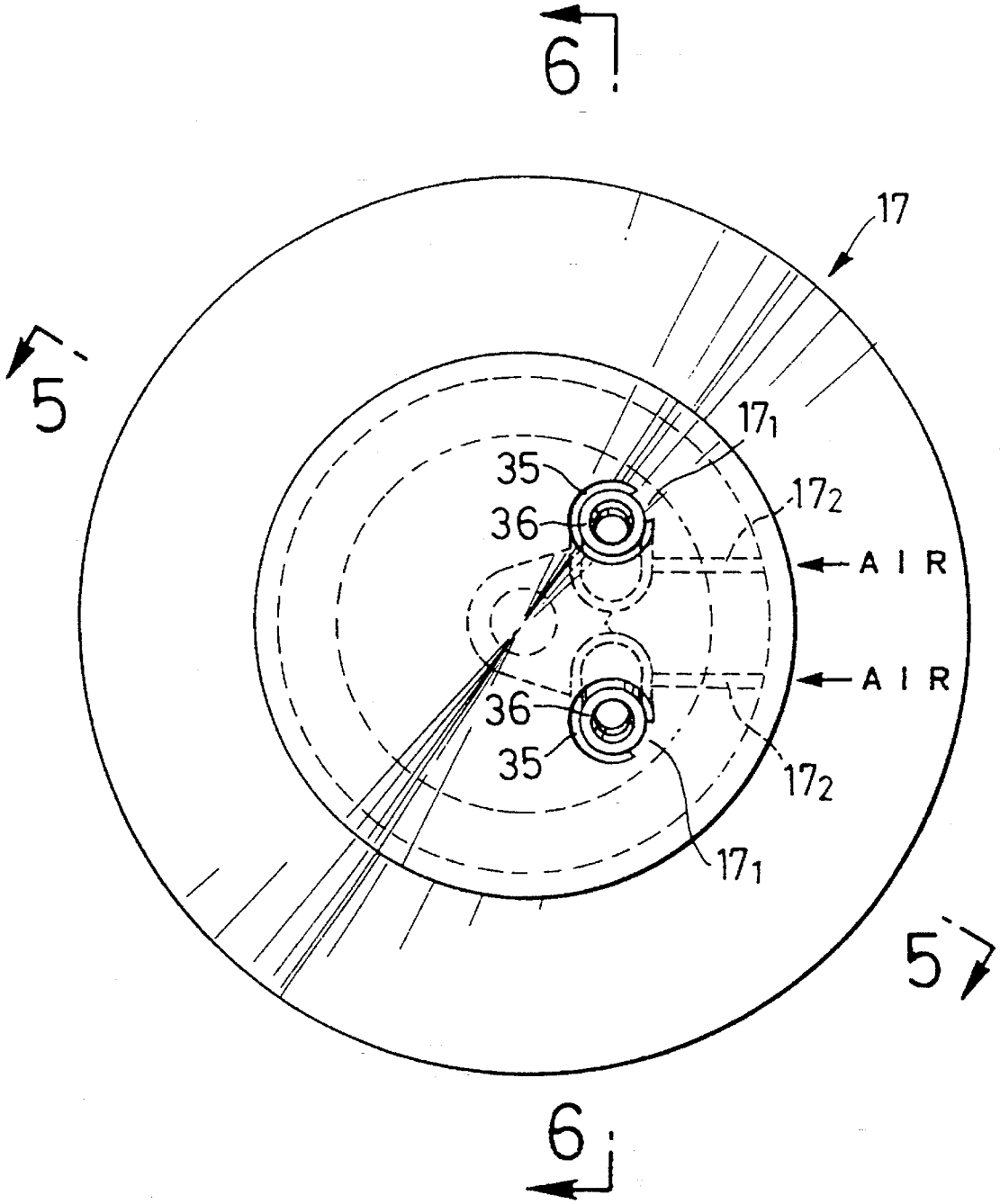
FIG. 4 is an enlarged sectional view taken along a line 4—4 in FIG. 3.

As shown in FIG. 3, the solenoid type fuel injection valve I includes a substantially cylindrical body housing 11. A bobbin 13 having a coil 12 wound around an outer periphery thereof, a yoke 14, a stopper plate 15, an injector body 16 and a cap 17 are fitted within the body housing 11 from below in the named order and fixed by caulking a lower edge of the body housing 11 to an outer periphery of the cap 17. A portion of the body housing 11 located inside the bobbin 13 constitutes a stationary core $\mathbf{11}_1$, and a portion of the body housing 11 located outside the coil 12 constitutes a yoke $\mathbf{11}_2$. A movable core 18 is vertically movably accommodated in a space which is defined by an inner periphery of a lower portion of the bobbin 13 and an inner periphery of the yoke 14. A tubular spring seat 19 is press-fitted from above into the center of the body housing 11, and the movable core 18 is biased downwardly by a valve spring 20 which is compressed between the movable core 18 and the spring seat 19.

Figure 5:
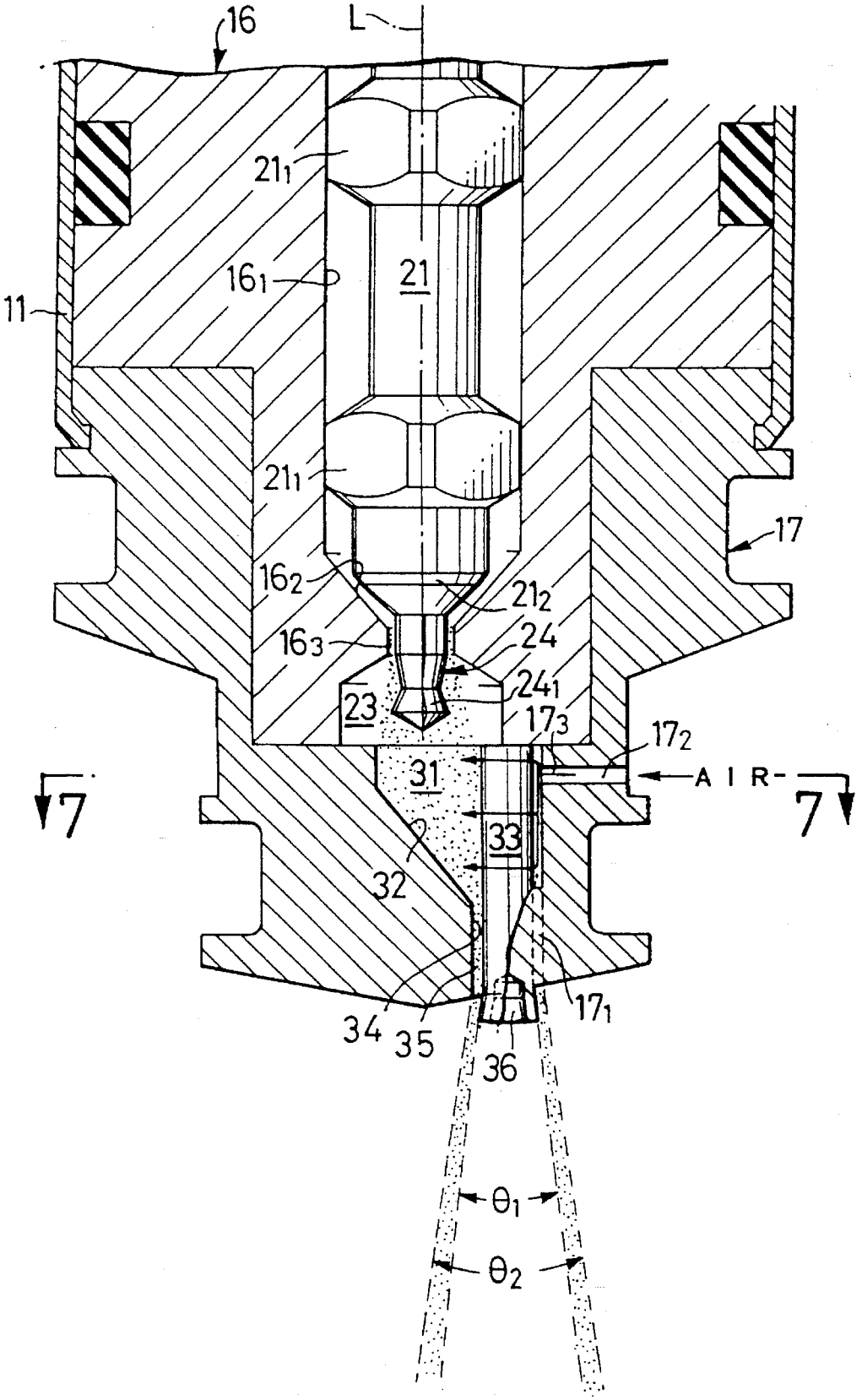
FIG. 5 is a sectional view taken along a line 5—5 in FIG. 4.
Figure 6:
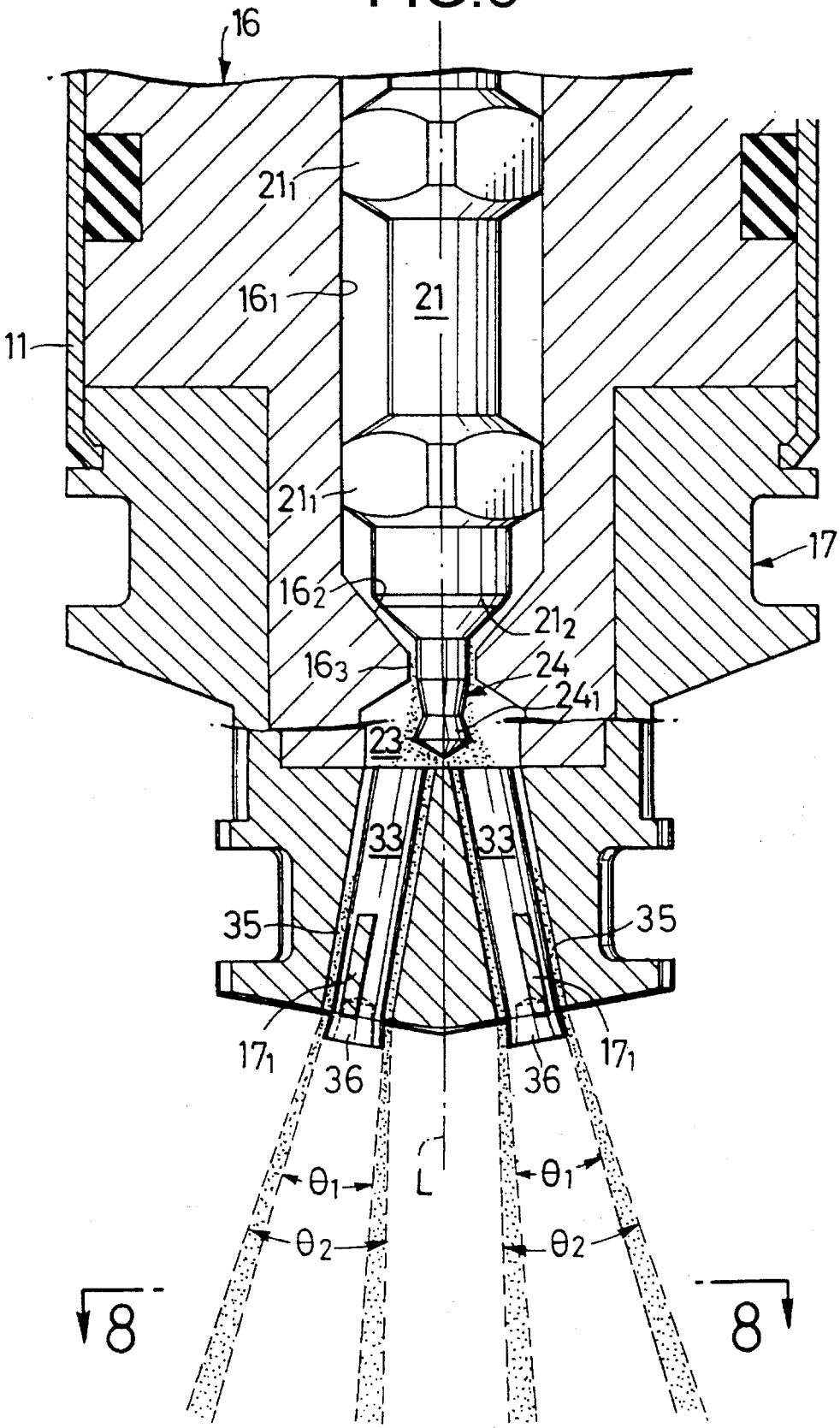
FIG. 6 is a sectional view taken along a line 6—6 in FIG. 4.
Figure 7:
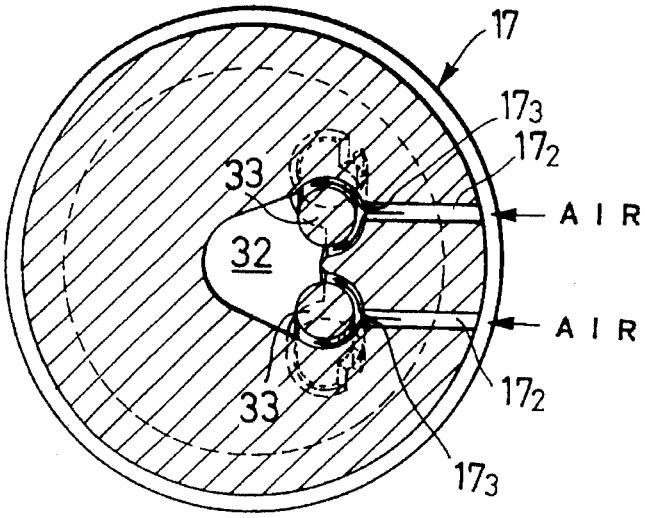
FIG. 7 is a sectional view taken along a line 7—7 in FIG. 5.

As can be seen from FIGS. 5 and 6, a needle valve 21 is fixed to the movable core 18 by caulking to extend downwardly. The needle valve 21 has a pair of guide portions $\mathbf{21}_1$, $\mathbf{21}_1$ substantially rectangular in section and slidably fitted in guide holes $\mathbf{16}_1$ which are circular in section and provided in the injector body 16. A valve portion $\mathbf{21}_2$ formed at a lower portion of the needle valve 21 is seatable on a valve seat $\mathbf{16}_2$ connected to a lower portion of the guide hole $\mathbf{16}_1$. Thus, an annular fuel injection hole $\mathbf{16}_3$ is opened and closed by the valve portion $\mathbf{21}_2$ and the valve seat $\mathbf{16}_2$.

In a state where the coil 12 wound around the bobbin 13 is deenergized, the movable core 18 and the needle valve 21 are biased downwardly by a resilient force of the valve spring 20, so that the valve portion $\mathbf{21}_2$ is seated on the valve seat $\mathbf{16}_2$. When the coil 12 is energized to attract the movable core 18 upwardly against the resilient force of the valve spring 20, the needle valve 21 is moved upwardly so that the valve portion $\mathbf{21}_2$ is separated from the valve seat $\mathbf{16}_2$. FIGS. 3, 5 and 6 shows the needle valve 21 in a condition in which it has been moved upwardly and thus, the valve portion $\mathbf{21}_2$ has been spaced apart from the valve seat, thereby opening the fuel injection hole $\mathbf{16}_3$. At this time, the stroke of the needle valve 21 is limited by the abutment of a flange $\mathbf{21}_3$ formed at an intermediate portion of the needle valve 21 against a lower surface of the stopper plate 15.

When the fuel injection hole $\mathbf{16}_3$ has been opened in the above manner, fuel supplied to an upper end of the body housing 11 from a fuel supply source (not shown) is passed through a filter 22, an internal space of the spring seat 19, a through-hole $\mathbf{18}_1$ of the movable core 18, an internal space of the yoke 14, a through-hole $\mathbf{15}_1$ in the stopper plate 15, clearances between the guide hole $\mathbf{16}_1$ in the injector body 16 and the guide portions $\mathbf{21}_1$, $\mathbf{21}_1$ of the needle valve 21, a clearance between the valve portion $\mathbf{21}_2$ and the valve seat $\mathbf{16}_2$ and the fuel injection hole $\mathbf{16}_3$, and is injected into a fuel atomizing space 23. At this time, the amount of fuel injected from the solenoid fuel injection valve I is measured by controlling the time and length of energization of the coil 12.

The needle valve 21 is integrally formed at a lower end thereof with a pintle 24 which extends through the fuel injection hole $\mathbf{16}_3$ into the fuel atomizing space 23. The pintle 24 has a valve head $\mathbf{24}_1$ formed at a lower end thereof and having an upwardly tapered surface.

As shown in FIGS. 4 to 7, a fuel distributing space 31 is defined within the cap 17, so that it is connected to a lower portion of the fuel atomizing space 23 in the injector body 16. An inclined wall surface 32 forming a lower wall of the fuel distributing space 31 is formed in such a manner that it is inclined from its upper end toward its lower end to traverse an axis L of the needle valve 21 from one side to the other side and is spread in lateral width. A pair of left and right fuel spray guide means 33, 33 are integrally provided on one side of the axis L of the needle valve 21, i.e., at the lower end of the inclined wall surface 32 to project from an inner wall surface of the cap 17. The pair of fuel spray guide means 33, 33 are formed such that their lower ends are laterally spread from each other in accordance with a bifurcation angle between the bifurcated intake ports **4*i*, 4*i***.

The cross-section of an upper half of each fuel injection spray guide means 33 is circular and completely separated from the inner wall surface of the cap 17. On the other hand, a lower half of each fuel injection spray guide means 33 is connected to the inner wall surface of the cap 17 by a support arm $\mathbf{17}_1$. Moreover, the lower half is surrounded by a guide wall surface 34 connected to a lower portion of the inclined wall surface 32 at a section excluding the support arm $\mathbf{17}_1$, thereby, forming a fuel injection passage 35 having a cross-section of a horseshoe or hoof shape.

Figure 8A:
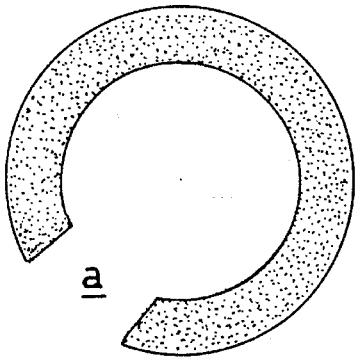
FIGS. 8*a* and 8*b* are a sectional view of a fuel spray pattern taken along a line 8—8 in FIG. 6.
Figure 8B:
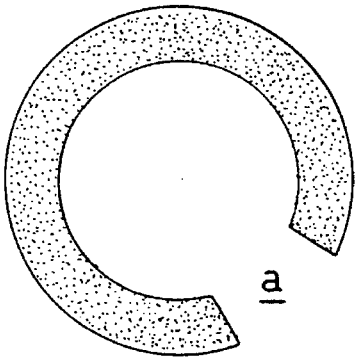

The fuel spray guide means 33 is formed at a lower end thereof with a fuel spray forming portion 36 which protrudes downwardly from the lower surface of the cap 17. The cross-sectional shape of the fuel spray forming portion 36 is tapered such that its downstream side is spread. Thus, the fuel passing through the fuel injection passage 35 is spread into a correct cone shape having a spray inside-angle $\theta_1$ and a spray outside-angle $\theta_2$. As can be seen from FIG. 8A and 8B, a fuel spray pattern is formed into a horseshoe shape having a non-spray portion a by blocking of a fuel spray by the support arm $\mathbf{17}_1$ of the fuel spray guide means 33.

A pair of air assist passages $\mathbf{17}_2$, $\mathbf{17}_2$ extend laterally from the sidewall of the cap 17 and have outlets $\mathbf{17}_3$, $\mathbf{17}_3$ opposed to sides of the upper halves of the fuel spray guide means 33, 33 with a small gap left therebetween on the opposite side from the axis L of the needle valve 21. The small gap is defined into a circular shape in section along an outer periphery of each fuel spray guide means 33.

An annular air chamber 40 (see FIG. 1) is formed between the cap 17 and the intake manifold **5*i* and connected to the air supply source (not shown), and inlets of the air assist passages $\mathbf{17}_2$, $\mathbf{17}_2$ open into the air chamber 40. Thus, when air from the air chamber 40 is supplied as assist air to the air assist passages $\mathbf{17}_2$, $\mathbf{17}_2$, this air is ejected from outlets $\mathbf{17}_3$, $\mathbf{17}_3$ and supplied to the fuel distributing space 31 around the outer periphery of each of the fuel spray guide means 33, 33**.

The operation of the embodiment of the present invention having the above-described construction will be described below.

When the coil 12 of the solenoid type fuel injection valve I is energized to move the needle valve 21 upwardly, the valve portion $\mathbf{21}_2$ of the needle valve 21 is separated from the valve seat $\mathbf{16}_2$ of the injector body 16 to open the fuel injection hole $\mathbf{16}_3$, thereby causing the high pressure fuel to be injected through the fuel injection hole $\mathbf{16}_3$ into the fuel atomizing space 23. The fuel injected into the fuel atomizing space 23 collides against the valve head $\mathbf{24}_1$, so that it is atomized while being radially diffused.

The atomized fuel is permitted to flow from the fuel atomizing space 23 into the fuel distributing space 31, where the fuel collides against the inclined wall surface 32 and is turned toward the pair of fuel spray guide means 33, 33, while the atomization is being promoted. In this manner, the fuel previously atomized by the pintle 24 is distributed to the pair of fuel spray guide means 33, 33 by the inclined wall surface 32. Therefore, even if there is an error produced in the relative positional relation between the pintle 24 and the pair of fuel spray guide means 33, 33, the fuel can be distributed substantially equally to both the fuel spray guide means 33, 33.

The fuel flowing to the pair of fuel spray guide means 33, 33 collides against and is uniformly mixed with the air which has been ejected from the outlets $\mathbf{17}_3$, $\mathbf{17}_3$ of the air assist passages $\mathbf{17}_2$, $\mathbf{17}_2$ to flow into the fuel distributing space 31, whereby the atomization and uniformization in particle size of the fuel are promoted. In this case, even if the supplying of the air has been stopped for any reason, it is possible to prevent the fuel spray from entering the air assist passages $\mathbf{17}_2$, $\mathbf{17}_2$ through the outlets $\mathbf{17}_3$, $\mathbf{17}_3$ by the fuel spray guide means 33 acting as a barrier, so that the entire amount of the fuel can be supplied to the fuel injection passages 35, 35, because the outlets $\mathbf{17}_3$, $\mathbf{17}_3$ are opposed to the fuel spray guide means 33, 33 and moreover, the fuel spray guide means 33, 33 are interposed between the outlets $\mathbf{17}_3$, $\mathbf{17}_3$ and the pintle 24, and the outlets $\mathbf{17}_3$ are opposed to the fuel spray guide means 33 with the small gap left therebetween on the opposite side from the axis L of the needle valve 21.

The fuel with its atomization promoted by the air is ejected from the fuel injection passages 35, 35 having the horseshoe-like cross section, wherein it is spread into the cone shape by the fuel spray forming portions 36, 36 of the fuel spray guide means 33, 33 and a portion of this fuel is blocked by the support arms $\mathbf{17}_1$, $\mathbf{17}_1$ to form the non-spray portions a, a.

The fuel atomized in the above manner is passed through the bifurcated intake ports **4*i*, 4*i* and sprayed toward gaps defined between the intake valve bores 9*i*, 9*i* and the valve heads $\mathbf{6}i_2$, $\mathbf{6}i_2$ of the intake valves 6*i*, 6*i*. At this time, because the non-spray lacked a, a of the fuel spray pattern correspond to the positions of the rod portions $\mathbf{6}i_1$, $\mathbf{6}i_1$of the intake valves 6*i*, 6*i***, it is possible to avoid the collision and deposition of the spray against and to the rod portion $\mathbf{6}i_1$, $\mathbf{6}i_1$ to effectively prevent a variation in air-fuel ratio.

In addition, it is possible to establish any fuel spray pattern only by changing the shapes of the fuel spray guide means 33, 33 (i.e., the shape of the cap 17) and therefore, it is possible to provide a solenoid type fuel injection valve I which is of a lower cost and has a higher general purpose property.

Although the embodiment of the present invention has been described in detail, it will be understood that the present invention is not limited to the above-described embodiment, and various modifications in design may be made without departing from the spirit and scope of the invention defined in claims.

Figure 9A:
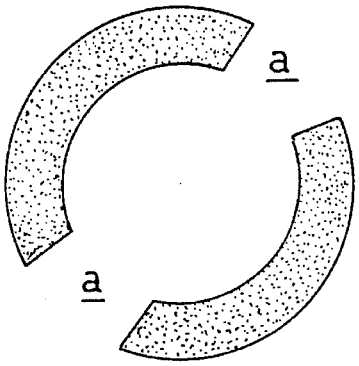
FIGS. 9*a* and 9*b* are a sectional view similar to FIG. 8, but showing a modification of a fuel spray pattern.
Figure 9B:
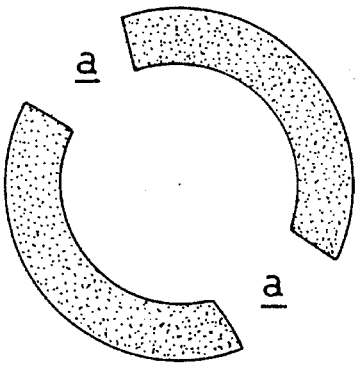

For example, although the non-spray portions a, a of the fuel non-spray pattern correspond to the rod portions **6*i*, 6*i* of the intake valves 6*i*, 6*i* in the embodiment, they may correspond to preselected portions of the intake ports 4*i*, 4*i* to which the fuel is liable to be deposited. By supporting each of the fuel spray guide means 33 by a pair of support arms $\mathbf{17}_1$, $\mathbf{17}_1$, it is possible to form a fuel spray pattern of a pair of sprays each having a pair of non-spray portions a, a opposed to each other as shown in FIGS. 9A and 9B, so that the pair of non-spray portions a, a can correspond to two portions in the intake port 4*i*** to which the fuel is liable to be deposited. Additionally, although the fuel is divided into the two flows by the solenoid type fuel injection valve I in the embodiment, it can be divided into three or more flows.

What is claimed is:

1. A solenoid type fuel injection valve, comprising:

a fuel injection hole formed in an injector body and opened and closed by a needle valve;

a cap mounted at a tip end of said injector body;

a fuel atomizing space formed at a position downstream of said fuel injection hole;

a pintle provided at a tip end of said needle valve to extend through said fuel injection hole into said fuel atomizing space for atomizing fuel passing through said fuel injection hole;

a fuel distributing space formed in said cap so as to be connected to a downstream side of said fuel atomizing space;

a plurality of fuel injection passages each having an annular cross-section and having at least one non-spray portion, said fuel injection passages being formed at a position downstream of said fuel distributing space, and offset from an axis of said pintle; and a fuel non-spray forming portion which spreads toward a downstream position thereof and is provided within a downstream end of each of said fuel injection passages for spreading a fuel non-spray into a cone shape.

2. A solenoid type fuel injection valve according to claim 1, wherein an inclined wall surface is formed within said fuel distributing space so as to face a tip end of said pintle and said fuel injection passages are connected to a lower end of said inclined wall surface.

3. A solenoid type fuel injection valve, comprising:

a fuel injection hole formed in an injector body and opened and closed by a needle valve;

a cap mounted at a tip end of said injector body;

a fuel atomizing space formed at a position downstream of said fuel injection hole;

a pintle provided at a tip end of said needle valve to extend through said fuel injection hole into said fuel atomizing space for atomizing fuel passing through said fuel injection hole;

a plurality of fuel spray guide means disposed within said cap downstream of said fuel atomizing space, such that said fuel spray guide means are offset from an axis of said pintle;

fuel injection passages each formed so as to surround an outer periphery of each of said fuel spray guide means; and air assist passages each having an outlet opposed to each of said fuel spray guide means on an opposite side from the axis of said pintle.

4. A solenoid type fuel injection valve according to claim 3, wherein a fuel distributing space is formed in said cap so as to be connected to a downstream side of said fuel atomizing space, and an inclined wall surface is formed within said fuel distributing space so as to face a tip end of said pintle, and wherein said fuel injection passages are connected to a lower end of said inclined wall surface.

5. A solenoid type fuel injection valve, comprising:

a fuel injection hole formed in an injector body and opened and closed by a needle valve;

a cap mounted at a tip end of said injector body;

a fuel atomizing space formed at a position downstream of said fuel injection hole;

a pintle provided at a tip end of said needle valve to extend through said fuel injection hole into said fuel atomizing space for atomizing fuel passing through said fuel injection hole;

a plurality of fuel spray guide means disposed within said cap downstream of said fuel atomizing space, such that said fuel spray guide means are offset from an axis of said pintle;

fuel injection passages each formed so as to surround an outer periphery of each of said fuel spray guide means; and air assist passages each having an outlet opposed to each of said fuel spray guide means with a small gap left therebetween.

6. A solenoid type fuel injection valve according to claim 5, wherein a small gap having a circular arc-shaped section is provided between said fuel spray guide means and the air assist passage to extend along an outer periphery of said fuel spray guide means.

7. A solenoid wall fuel injection valve according to claim 5, wherein a fuel distributing space is formed in said cap so as to be connected to a downstream side of said fuel atomizing space, and an inclined wall surface is formed within said fuel distributing space so as to face a tip end of said pintle, and wherein said fuel injection passages are connected to a lower end of said inclined wall surface.

8. A solenoid type fuel injection valve according to claim 1, 3 or 5, wherein said pintle includes a head portion having an upwardly-directed tapered surface.

* * * * *